United States Patent [19]

Bogar, Jr.

[11] 4,450,989

[45] May 29, 1984

[54] GUN RACK FOR MOTOR VEHICLES

[76] Inventor: Earl M. Bogar, Jr., P.O. Box 4152, Houston, Tex. 77210

[21] Appl. No.: 281,484

[22] Filed: Jul. 8, 1981

[51] Int. Cl.[3] ..... A47F 5/08; A47F 7/00

[52] U.S. Cl. ..... 224/42.45 R; 211/64; 211/87; 248/205.1

[58] Field of Search ..... 224/42.45, 913, 42.38, 224/42.39, 42.33; 211/87, 64, 60 R, 60 SK, 86, 63, 96; 248/201, 224.4, 295.1, 205 R, 216.1

[56] References Cited

U.S. PATENT DOCUMENTS

| | | | |
|---|---|---|---|
| 1,552,535 | 9/1925 | Beerstecher | 248/201 |
| 3,167,182 | 1/1965 | Calvin | 211/64 |
| 3,767,093 | 10/1973 | Pinkerton et al. | 224/913 |
| 3,931,893 | 1/1976 | Elkins et al. | 211/87 |
| 4,132,381 | 1/1979 | McClellan | 211/60 R |
| 4,271,997 | 6/1981 | Michael | 224/42.45 R |

*Primary Examiner*—Allan N. Shoap

*Assistant Examiner*—Robert Petrik

*Attorney, Agent, or Firm*—Harvey B. Jacobson

[57] ABSTRACT

A rack for supporting guns in a motor vehicle which includes end plates which can be easily installed between the surface of a rear window and the resilient molding, which encircles the edge of the rear window, with one or more cradle elements being integral with one component of the rack and the other component of the rack including structure to enable adjustment of the length of the rack and relative pivotal movement when the rack is installed, whereby the two end plates may be engaged with the resilient molding when the two components of the rack are in angular relation and the two components then are moved to an in-line condition and secured in that condition to enable quick installation. Each end plate is provided with foldable edge wings to facilitate packaging and each of the cradle elements is provided with a gun retaining structure to retain the gun in a pair of spaced gun racks.

17 Claims, 7 Drawing Figures

FIG. 1
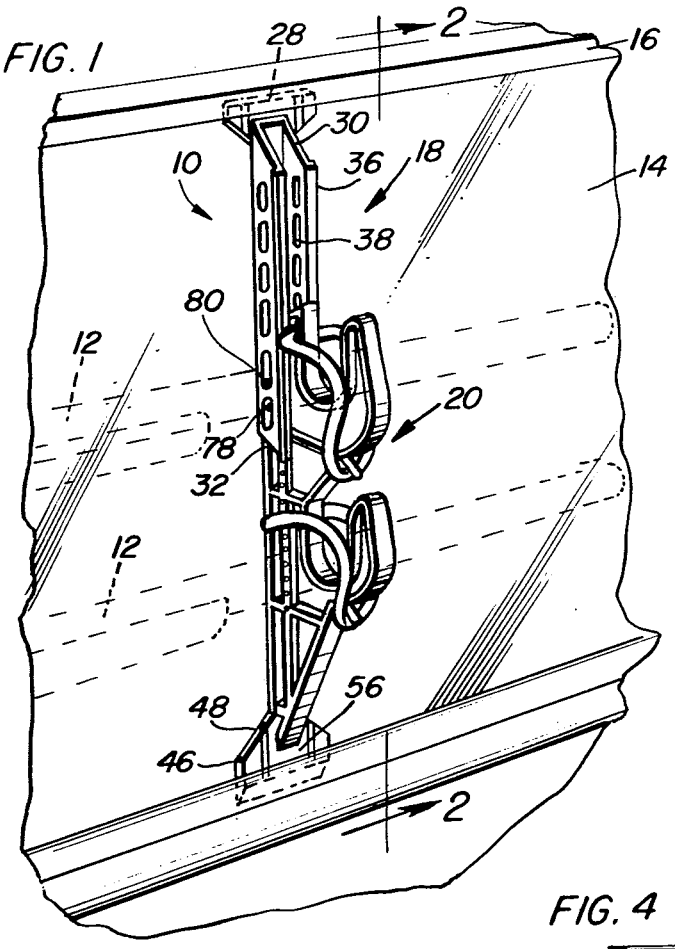
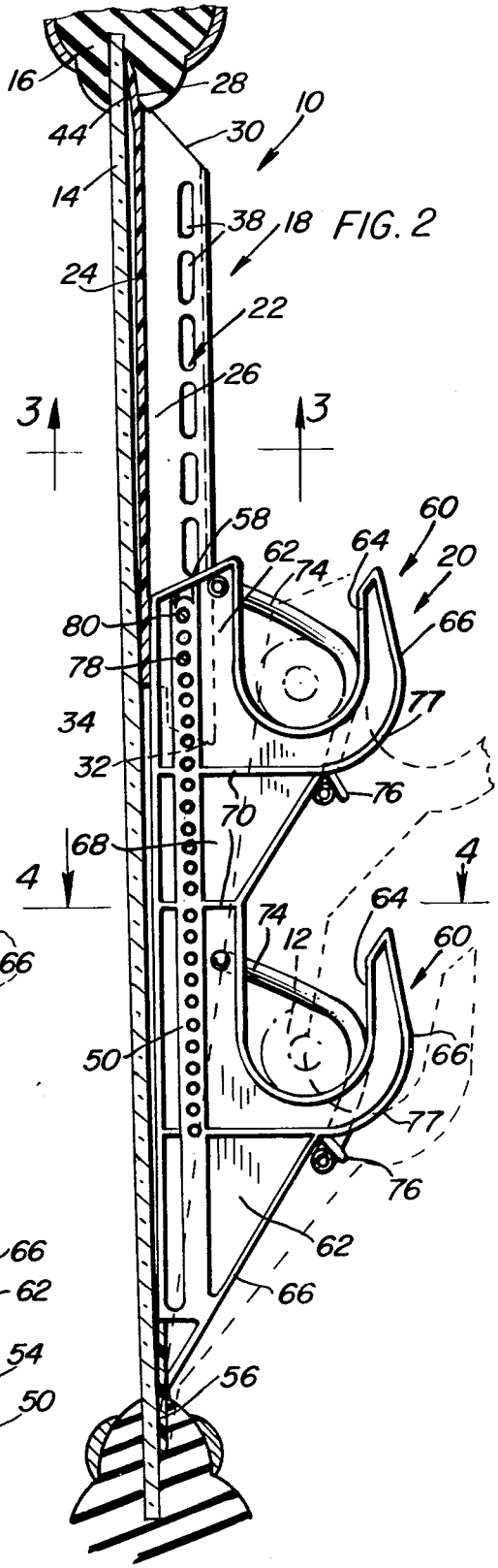
FIG. 2
FIG. 3
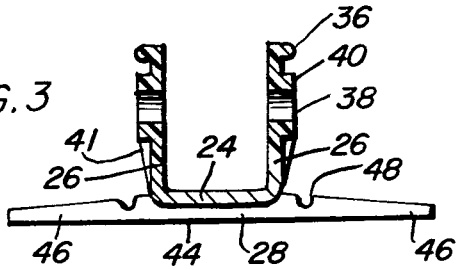
FIG. 4
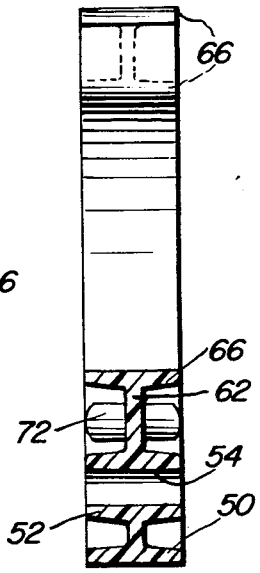
FIG. 5
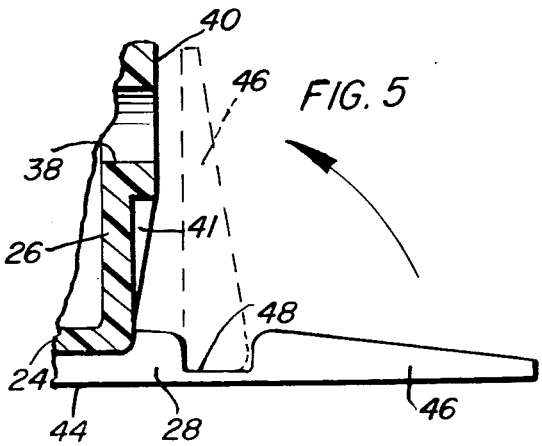

GUN RACK FOR MOTOR VEHICLES

BACKGROUND OF THE INVENTION

1. Field of the Invention

The present invention generally relates to a gun rack for rifles, shotguns or other relatively long, slender rigid objects, with the rack being engaged with a resilient molding such as that encircling the peripheral edge of a rear window in a vehicle, such as a pick-up truck or the like, and more particularly to such a rack having folding wings at the side edges of each of the end supporting plates, resilient retaining members securing the gun in the cradle elements and a unique structure to facilitate quick and secure installation of the rack.

2. Description of the Prior Art

My prior U.S. Pat. No. 4,108,313, issued Aug. 22, 1978, discloses a vehicle mounted gun rack of the type which includes a pair of longitudinally extensible components with each component including an end plate and one of the components including a pair of cradle elements to support a rifle, shotgun or the like. The prior art of record in that patent discloses other developments in this type of gun rack with all of the recently patented stuctures including spaced racks mounted vertically along the interior surface of the rear window of a vehicle or the like and including end plate structures for securing the rack in position, with the rack including two components which are longitudinally adjustable in relation to each other in order to enable the end plates to be moved outwardly into engagement with the vehicular structure, such as the resilient molding around the periphery of the vehicle window. While such prior structures have served a useful purpose, it is desirable to provide a more effective arrangement to install the gun racks, since it is rather difficult to insert the tapered edges of the end plates into position between the molding and glass or into the molding itself and in addition, guns supported in the gun rack sometimes become dislodged due to travel over uneven terrain and such structures are relatively bulky to package in blister packaging, and the like.

SUMMARY OF THE INVENTION

An object of the present invention is to provide a gun rack for motor vehicles for effectively supporting rifles, shotguns, or similar firearms or elongated rigid objects in horizontal position interiorly of a vehicle window, such as the rear window of a truck, in which the window is surrounded by a resilient molding and the window is substantially vertically oriented, with the gun or guns being supported by a pair of longitudinally spaced gun racks in a well known manner. Each of the gun racks of the present invention includes a pair of components, each of which is provided with a generally flat tapering end plate for insertion between the molding and window glass and a unique structural arrangement to enable the two components to be installed by orienting them in angular relation to each other, engaging the two end plates in the area at the juncture between the window glass and molding and the overlapping ends pivotally connected so that the two components of the gun rack can then be moved toward the window glass into a straight line condition, thereby easily forcing the end plates inwardly between the window glass and molding, with the two components then being secured in aligned relationship, thereby providing rapid but secure mounting of the gun rack.

Another object of the invention is to provide a gun rack in accordance with the preceding object in which one or more cradle elements are formed on the gun rack with each cradle element including a resilient member to retain the gun in the cradle element in a manner which is secure but yet easily rendered effective and ineffective.

Still another object of the invention is to provide a gun rack in accordance with the preceding objects in which the two end plates are provided with spaced parallel vertical hinges to enable the end portions or side wings thereof to be folded into parallel relation to the side surfaces of the gun rack to enable the gun rack to be packaged in a more compact manner, with the two components of the gun rack including the end plates being constructed of plastic with the hinge structure being a "living hinge" to enable the rack to be economically manufactured and effectively packaged and distributed.

A further object of the invention is to provide a gun rack which is relatively inexpensive to manufacture, effective for the purpose of supporting guns and the like, capable of being packaged in a compact manner for easy distribution and rapidly and securely installed by owners of motor vehicles and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of one of the gun racks, with it being pointed out that a pair of gun racks oriented in spaced parallel relation are used to support guns, and the like.

FIG. 2 is a vertical sectional view of the gun rack taken substantially along section line 2—2 of FIG. 1 with portions show in elevation.

FIG. 3 is a transverse, sectional view taken substantially upon a plane passing along section line 3—3 of FIG. 2, illustrating the structural details of one of the components of the gun rack.

FIG. 4 is a transverse sectional view taken substantially upon a plane passing along section line 4—4 of FIG. 2, illustrating the structural details of the other component of the gun rack.

FIG. 5 is a fragmental enlarged sectional view of the end portion of one of the gun racks with the end plate illustrated in elevation and illustrating the hinge structure for the wing edges of the end plate.

DESCRIPTION OF THE PREFERRED EMBODIMENT

Figure 6:
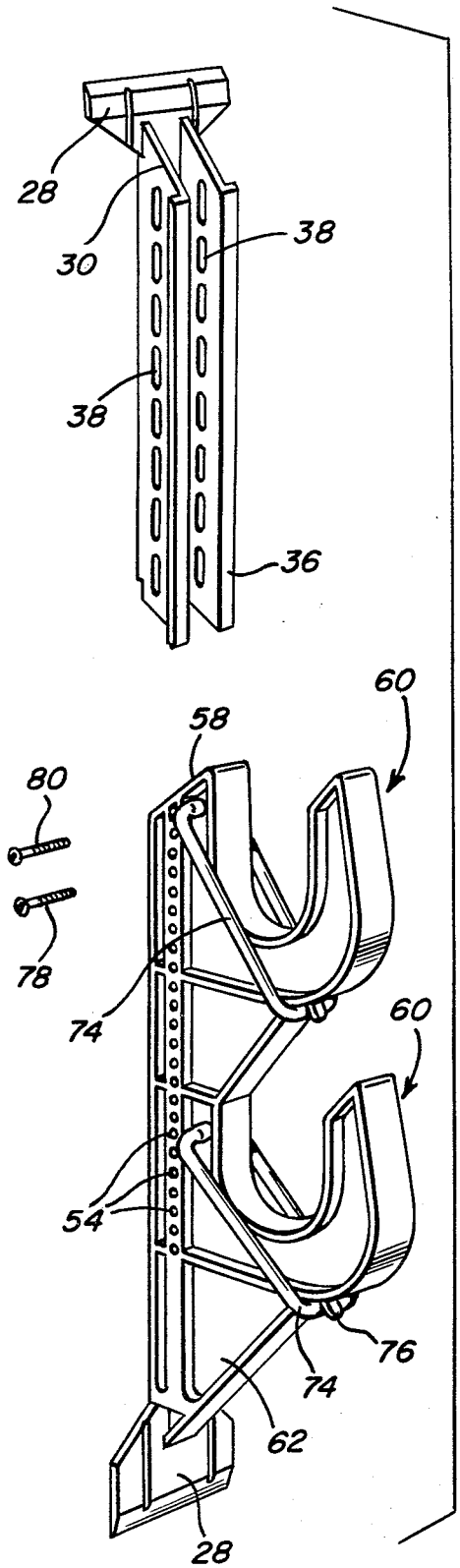
FIG. 6 is a group perspective view of the components of the present invention.

Referring now specifically to the drawings, the gun rack of the present invention is generally designated by reference numeral 10 with only one of the racks being illustrated, but it being understood that two longitudinally spaced, vertically disposed parallel gun racks 10 would be used to support a gun or guns 12, such as a rifle, shotgun, or other elongated rigid object, with the racks being spaced apart a distance sufficient to effectively support such items. The gun rack 10 is mounted alongside of the inner surface of a window glass 14 such as the vertically disposed rear window of a pick-up truck or the like which conventionally is provided with a resilient molding 16 peripherally thereof with the edge of the glass 14 being embedded therein and usually secured thereto by adhesive, sealant, and the like. The aforementioned structure of the window glass and molding are conventional in and of themselves and the gun rack 10 is oriented in relation to the window glass 14 as illustrated in FIGS. 1 and 2.

The gun rack 10 includes two components 18 and 20 with the component 18 being an upper component and the component 20 being a lower component. The gun rack component 18 includes an elongated channel-shaped portion 22 having a continuous bight portion 24 and parallel leg portions 26 projecting therefrom and an end plate 28 at one end thereof with the ends of the legs being bevelled at 30 where the legs join with the end plate 28. The other end edges of the legs 26 are also inwardly inclined or bevelled as at 32 with the adjacent end of the bight portion 24, designated by numeral 34, spaced inwardly from the adjacent inner corner of the legs 26, as illustrated in FIG. 2. The upper component 18 is constructed of plastic material of unitary construction with the free longitudinal edges of the legs 26 including a reinforcing rib 36 along the outer edge thereof and the longitudinal central portion of each leg is provided with a plurality of longitudinally spaced and longitudinally elongated slots 38 which have peripheral reinforcing ribs or thickened areas 40 around the periphery thereof and transverse reinforcing ribs 42 at the center of each slot. Also, reinforcing ribs 41 extend from the bottom edge of the legs up to the reinforcement ribs 40 at certain areas thereof to provide a substantially rigid structure with the space defined by the interior of the bight portion 24 and the two legs 26 being of U-shaped configuration and free of obstructions from end to end in order to telescopicly receive the upper end portion of the lower component 20.

The end plate 28 is tapered or bevelled along its outer surface where it engages the molding 16 and its inner surface is angulated slightly inwardly as at 44 to space the bight portion 24 slightly away from the window 14 as illustrated in FIG. 2. Also, the end plate is provided with laterally extending edge portions or wings 46 which are joined with the remainder of the end plate by a living hinge 48 formed by providing a groove or crease in the outer surface of the end plate 28 with the two grooves or creases being parallel and adjacent the legs 26 to enable the wings 46 to fold upwardly to a position alongside the legs 26 as illustrated in FIG. 5 or downwardly into generally parallel relation for more compact packaging.

The lower component 20 is also of one-piece plastic material and includes an elongated member 50 of I-shaped configuration having a thickened web portion 52 provided with a plurality of longitudinally spaced apertures 54 therethrough. An end plate 56 similar to the end plate 28 is integral with the lower end of the lower component 20 and the upper end of the member 50 is bevelled or inclined as at 58 with this edge being defined by a reinforcing flange a continuation of the inner flange of the member 50. Projecting outwardly from and integral with the member 50 is a pair of cradle elements generally designated by numeral 60, each of which includes a projecting plate 62 having a generally U-shaped recess or cradle 64 formed therein with the peripheral edge of the plate and the peripheral edge of the recess being provided with a transverse reinforcing flange 66. the lower cradle element 60 is in alignment with the upper cradle element 60 with the plate 62 being continuous and narrowed at the central portion between the two cradle as indicated by numeral 68 with reinforcing ribs 70 being provided on the plates 62 and 68 with the peripheral flange 66 being continuous as illustrated in FIG. 2. Also, the lower cradle element 60 includes a continuation of the plate 62 downwardly to its juncture with the end plate 56 and the peripheral reinforcing flange 66 extends all the way to a central portion of the end plate 56, as illustrated in FIG. 2, thus forming a rigid structure, but yet one which is of unitary construction and can be easily formed by conventional plastic forming techniques.

At the upper end of each U-shaped recess 64, adjacent the inner corner thereof, the plate 62 is provided with a pin 72 projecting from opposite sides thereof with the pin including rounded end portions to enable insertion of one end of a piece of elastic tubing 74 to be telescoped thereover and secured thereto, with the central portion of the resilient tubing 74 being capable of being stretched down over the outer reinforcing flange 66 and positioned under a projecting lug 76 at the lower end of the inwardly curved portion 77 of the flange 66 as illustrated in FIG. 2, so that the resilient tubing will serve as an effective means for retaining the gun 12 in position in the cradle element 60. The resilient tubing 74 may be conventional surgical tubing, plastic or the like, having resilient characteristics sufficient to retain the gun in,position in a secure manner, but yet enable the gun to be easily removed of placed in the gun rack when desired.

Figure 7:
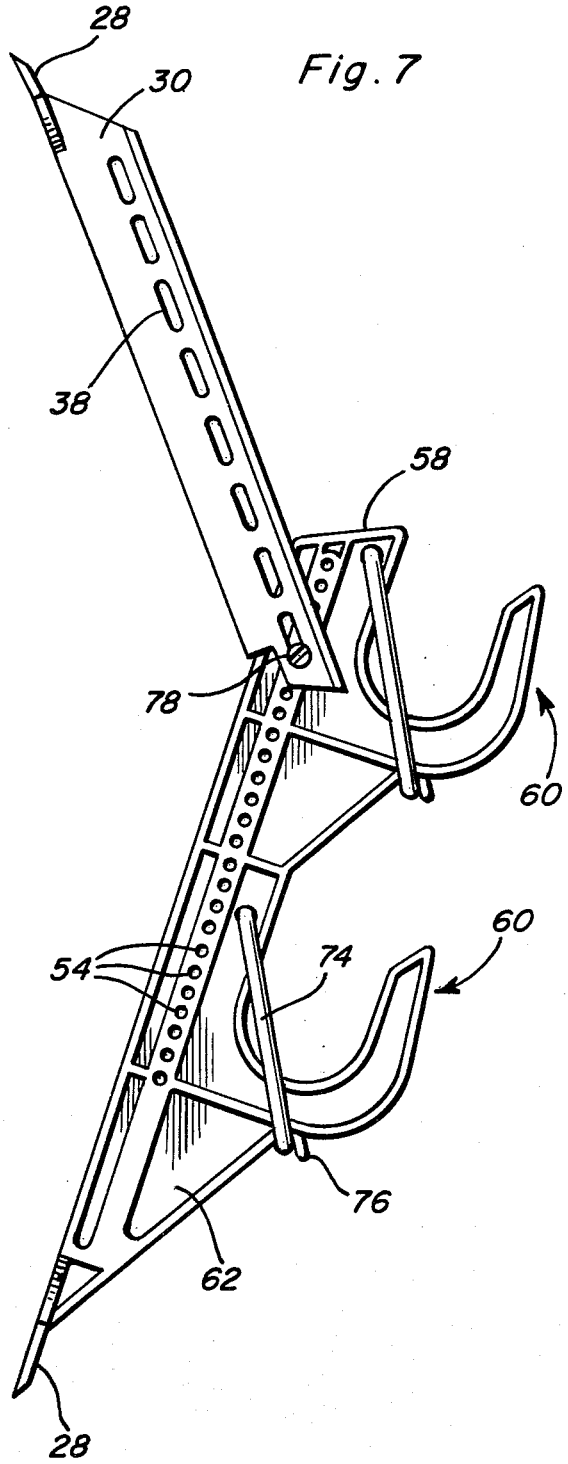
FIG. 7 is a schematic side elevational view illustrating the hinge action of the components of the rack.

The gun rack may be easily assembled with respect to the window and molding by positioning the two components 18 and 20 so that the end plates 28 and 56 engage the area where the molding 16 engages the window 14 with a bolt 78 positioned in the lowermost slot 38 in the upper component and through an aligned aperture 54 in the lower component with the two components 18 and 20 having the overlapping ends pivoted outwardly as illustrated in dotted lines in FIG. 2 generally in the form of a folding knee brace or the like as shown in FIG. 7. The overlapping portions of the components 18 and 20 which are then pivotally connected by the bolt 78 are forced inwardly so that these components become vertically aligned and the upper end of the lower component 20 is received between the legs 26 of the upper component and a second bolt 80 is then inserted to retain the components in alignment. This enables easy installation of the gun rack since inward movement of the overlapping portions of the components as they pivot about the bolt 78 will cause the tapered outer ends of the end plates 28 and 56 to penetrate the molding along the surface of the window glass as illustrated in FIG. 2, thus eliminating the necessity of manually longitudinally expanding the two components which is necessary when installing previously known gun racks which involve overlapping slots which restrict relative movement to longitudinal sliding movement.

Accordingly, the gun rack of the present invention provides easy and rapid installation and also provides secure retention of the guns in the racks and easy removal thereof and further enables compact packaging by enabling the wings 46 of the end plates to be folded into parallel relationship to each other, thereby reducing the size of the package necessary for the pair of gun racks which are normally blister packaged.

The foregoing is considered as illustrative only of the principles of the invention. Further, since numerous modifications and changes will readily occur to those skilled in the art, it is not desired to limit the invention to the exact construction and opeation shown and described, and accordingly, all suitable modifications and equivalents may be resorted to, falling within the scope of the invention.

What is claimed as new is as follows:

1. A rack for supporting guns comprising an upper component and a lower component each having an end plate for engagement with a supporting structure, means connecting adjacent ends of the components, and means on at least one of the components for supportingly engaging a gun each of said end plates being relatively thin and provided with laterally extending side edges, hinge means connecting the laterally extending side edges to the remainder of the end plate to enable the side edges of the end plates to fold into parallel relationship to provide compact packaging of the rack.

2. The structure as defined in claim 1, wherein each of said components is constructed of plastic material with the end plates being also constructed of plastic material unitary with the components, said hinge means including a living hinge formed in the plastic material by forming a groove in one surface of the plastic material to define a hinge axis for pivoting the side edges of the end plate into perpendicular relation to the remainder of the end plate.

3. The structure as defined in claim 1, wherein said means on one of said components for supporting a gun includes a generally hook-shaped, upwardly opening cradle, and means on said cradle to retain the gun in place therein.

4. The structure as defined in claim 3, wherein said means retaining the gun in the cradle includes an elongated resilient member having the free ends thereof anchored to the cradle adjacent the component on which the cradle is mounted, the central portion of the resilient member extending outwardly to engage the outer end portion of the hook-shaped cradle in overlying relation to a gun positioned in the cradle.

5. The structure as defined in claim 4, wherein said resilient member is in the form of resilient tubing, a pin projecting from each side of the component adjacent the inner portion of the cradle and securely anchoring the tubular ends of the resilient tubing thereto, and an outwardly projecting lug on the exterior of the cradle below the upper outer corner thereof for receiving the central portion of the resilient tubing when it is stretched into overlying relation to the gun and pulled downwardly over the outer surface of the cradle.

6. The structure as defined in claim 1, wherein said means securing the upper and lower components together includes a pivot bolt securing overlapping portions of the upper and lower components together to enable the end plates to be engaged with opposed surfaces of a supporting structure when the components are in angular relation to each other, after which the components can be moved to a straight line condition, and a second bolt securing the components in their straight line condition with the end plates expanded outwarly for secure engagement with the supporting structure.

7. In combination with the structure as defined in claim 6, a window of a motor vehicle having a peripheral molding of resilient material forming the supporting structure for the gun rack with outward movement of the end plates serving to anchor the rack to the upper and lower portions of the molding around the vehicle window such as the rear window of a truck.

8. The structure as defined in claim 7, wherein said upper component has an elongated member of transverse channel-shaped configuration telescopically receiving the upper end portion of the lower component with the means supporting the gun being located on the lower component.

9. A support rack comprising an upper component and a lower component, each of said components having an end plate at the outer end thereof for engagement with opposed surfaces of a supporting structure, the inner ends of said components being disposed in overlapping relation, means connecting the overlapping inner ends of the components to enable pivotal movement between a position with the components in angular relation to a position with the components in a straight line, and means on one of said components to support an article, said means connecting the overlapping inner ends of said components including a plurality of longitudinally spaced aperture means in each of said components, a first fastener means engaged with one pair of said aperture means and forming a pivot axis enabling the components to pivot from their angular relation position with the end plates disposed between the opposed surfaces of the supporting structure to a straight line position thereby projecting the end plates outwardly into secure engagement with the opposed surfaces and a second fastener means engaged with a second pair of aperture means when the components have been moved to their straight line position thereby securing the rack to the supporting structure.

10. The rack as defined in claim 9 wherein said means supporting an article includes an upwardly opening cradle on one of said components, a resilient member extending across said cradle in overlying relation to an article positioned in said cradle, and means anchoring the resilient member to said one component to resiliently bias the article against the surface of the cradle and enable easy release and attachment of a portion of the resilient member to enable placement of the article in the cradle and removal therefrom when desired.

11. The rack as defined in claim 10 wherein said resilient member has a pair of ends, said means anchoring the resilient member to said one component including means anchoring the ends of the resilient member to said one component inwardly of the cradle and a projection on the outer surface of the cradle, the central portion of the resilient member being positioned under the projection to retain the article in the cradle.

12. The rack as defined in claim 9 wherein each of said end plates includes side edge portions extending laterally beyond the components, hinge means connecting the side edge portions of the end plates to the remainder of the end plates to enable the side edge portions to fold into parallel relation to each other adjacent the component.

13. The rack as defined in claim 12 wherein said components are of one-piece plastic material and said hinge means is a living hinge formed by a groove in the end plates, said upper component being channel-shaped and receiving the upper end portion of the lower component therein, said means supporting an article including an upwardly opening cradle on the lower component.

14. The rack as defined in claim 9 wherein said first fastener means is engaged with aperture means spaced from the inner end of one of said components with the second fastener means being longitudinally spaced therefrom when the components are in straight line position.

15. In combination with the rack of claim 9, the supporting structure comprising a vehicle panel having a peripheral molding of resilient material, said end plates having a thin outer edge engaged with the molding when the end plates are projected outwardly when said components are pivoted from their angular relation position to their straight line position.

16. The combination as defined in claim 15 wherein said means supporting an article includes an upwardly opening cradle on one of said components, a resilient member extending across said cradle in overlying relation to an article positioned in said cradle, and means anchoring the resilient member to said component to resiliently bias the article against the surface of the cradle and enable easy release and attachment of a portion of the resilient member to enable placement of the article in the cradle and removal therefrom when desired, said member having a pair of ends, said means anchoring the resilient member to said one component includes means anchoring the ends of the resilient member to said one component inwardly of the cradle and a projection on the outer surface of the cradle, the central portion of the resilient member being positioned under the projection to retain the article in the cradle.

17. The combination as defined in claim 16 wherein each of said end plates includes side edge portions extending laterally beyond the components, hinge means connecting the side edge portions of the end plates to the remainder of the plates to enable the side edge portions to fold into parallel relation to each other adjacent the component, said components are of one-piece plastic material and said hinge means is a living hinge formed by a groove in the end plates, said upper component being channel-shaped and receiving the upper end portion of the lower component therein, said means supporting an article including an upwardly opening cradle on the lower component.

* * * * *